US009416597B2

(12) United States Patent
Fagg

(10) Patent No.: US 9,416,597 B2
(45) Date of Patent: Aug. 16, 2016

(54) COMPRESSIBLE BEARING ASSEMBLY FOR DOWNHOLE TOOLS AND METHODS OF OPERATION OF SAME

(71) Applicant: Baker Hughes Incorporated, Houston, TX (US)

(72) Inventor: Hayden V. Fagg, Longview, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 356 days.

(21) Appl. No.: 13/714,597

(22) Filed: Dec. 14, 2012

(65) Prior Publication Data

US 2014/0166365 A1 Jun. 19, 2014

(51) Int. Cl.
*E21B 17/07* (2006.01)
*E21B 4/00* (2006.01)

(52) U.S. Cl.
CPC ..... *E21B 17/073* (2013.01); *E21B 4/003* (2013.01)

(58) Field of Classification Search
CPC ..... E21B 10/22; E21B 17/07; E21B 17/073; E21B 17/076; E21B 4/003; F16C 31/00; F16C 31/02; F16C 32/0681
USPC ..... 175/325.2, 325.3, 359
See application file for complete search history.

(56) References Cited

U.S. PATENT DOCUMENTS 5,265,684 A * 11/1993 Rosenhauch ..... 175/61
5,368,110 A * 11/1994 French ..... 175/57
5,964,307 A * 10/1999 Wenzel ..... 175/321
2004/0026131 A1* 2/2004 Boulet et al. ..... 175/325.3
2007/0000695 A1* 1/2007 Laflin ..... E21B 17/073 175/57
2010/0326730 A1* 12/2010 Prill et al. ..... 175/57

FOREIGN PATENT DOCUMENTS

WO WO 2012/069858 A2 * 5/2012

OTHER PUBLICATIONS

Canadian Intellectual Property Office; Office Action issued in CA Application No. 2,835,675; Nov. 26, 2014.

* cited by examiner

*Primary Examiner* — Robert E Fuller
*Assistant Examiner* — Christopher Sebesta
(74) *Attorney, Agent, or Firm* — Parsons Behle & Latimer

(57) ABSTRACT

Bearing assemblies for downhole tools include a compensator member operatively associated with a slidable member and a bearing member. The slidable member is movable longitudinally relative to the bearing member. Such movement of slidable member occurs when a force acts upwardly on the downhole tool. Thus, the slidable member facilitates absorption of the upward force acting on the downhole tool. During movement of the slidable member, the compensator member is moved from its expanded position to one of its plurality of compressed positions. As a result, the compensator member becomes biased or further biased toward the expanded position. After the upward force dissipates, the compensator member releases some of its stored energy to move from a compressed position toward the expanded position. Longitudinal movement of the slidable member facilitates maintaining engagement of the downhole tool in its working position so that interruptions of operations are minimized.

13 Claims, 2 Drawing Sheets

COMPRESSIBLE BEARING ASSEMBLY FOR DOWNHOLE TOOLS AND METHODS OF OPERATION OF SAME

BACKGROUND

1. Field of Invention

The invention is directed to bearing assemblies and, in particular, to longitudinally compressible bearing assemblies for conventional motors used in downhole tools for compensating longitudinal movement of a portion of the downhole tool during operation in an oil, gas, and/or water well.

2. Description of Art

Rotatable drill strings having a drill bit at a lowermost end are known in the art. Bearing assemblies for such drill strings are also known in the art. In general, a motor is included in the drill string in close proximity to the drill bit. Rotation of the drill bit by the motor can cause the drill bit to cut or abrade the formation to form the wellbore. The bearing assembly permits rotation of the drill bit by the motor, yet allows the remainder of the drill string to remain stationary, i.e., not rotated.

SUMMARY OF INVENTION

Broadly, bearing assemblies for inclusion in tubular strings disposed in a wellbore comprise a compensator member operatively associated with a bearing member. A rotatable tubular is operatively associated with the bearing assembly so that rotation of the entire tubular string having the bearing assembly is not required when the tubular is rotated. The compensator member includes an expanded position and a plurality of compressed positions. In each of the compressed positions, the compensator member is biased toward the expanded position.

The compensator member can comprise a chamber which is operatively associated with a slidable member. The chamber permits the slidable member to slide longitudinally relative to the bearing member so that a rotatable downhole tool, such as a drill bit, can absorb forces acting upward on the drill bit. In doing so, the chamber becomes energized which facilitates returning the compensator member to the expanded position after the upward force dissipates.

Figure 1:
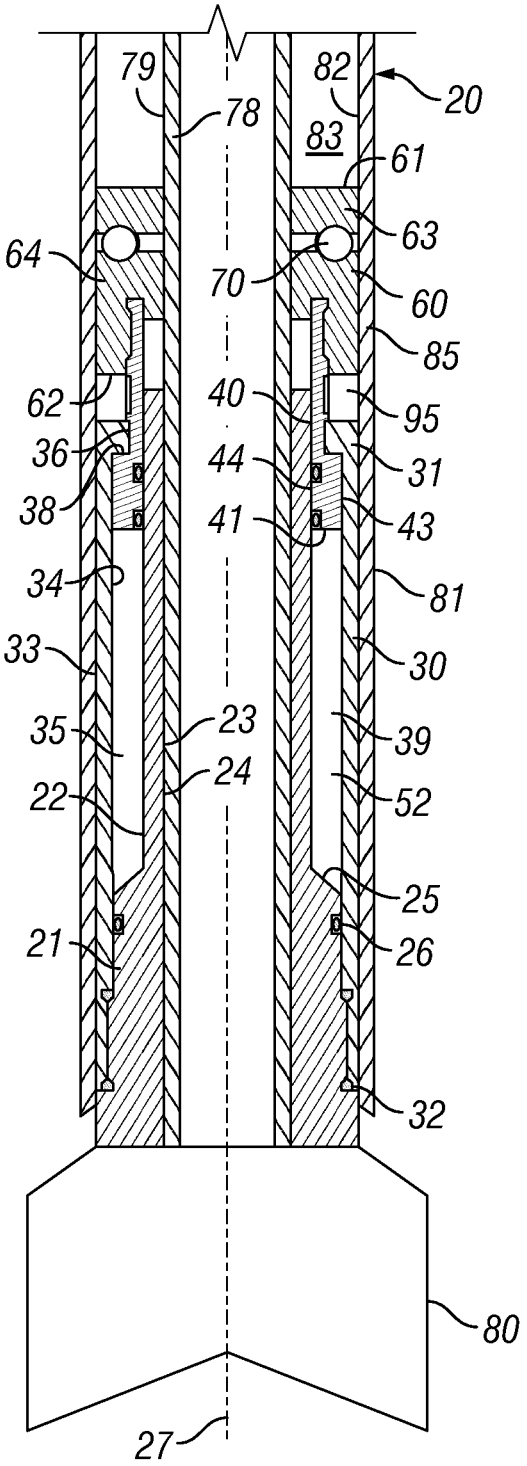
FIG. 1 is a partial cross-sectional view of a specific embodiment of a downhole tool having a bearing assembly disclosed herein shown in an expanded position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

As discussed above, broadly, the bearing assemblies comprise a slidable member and a compensator member. Referring to the particular embodiment of FIGS. 1-2, bearing assembly 20 comprises a slidable member operatively associated with a compensator member. Slidable member comprises mandrel 21 having outer wall surface 22, inner wall surface 23 defining mandrel bore 24, and longitudinal axis 27.

Outer wall surface 22 includes shoulder 25. Mandrel 21 is operatively associated with a rotating downhole tool such as drill bit 80 which is operatively associated with rotating tubular 78 through any known fastener device known in the art, including but not limited to, threads (not shown). An upper end of rotatable tubular 78 is operatively associated with a motor (not shown). Activation of the motor causes rotatable tubular 78 to rotate which, in turn, causes drill bit 80 to rotate so that an object such as the formation of a wellbore can be drilled or abraded away.

Secured to outer wall surface 22 of mandrel 21 is shroud 30. Shroud 30 includes upper end 31, lower end 32, outer wall surface 33, and inner wall surface 34 defining shroud bore 35. Upper end 31 includes opening 36 in fluid communication with shroud bore 35. Opening 36 defines shroud shoulder 38. Lower end 32 of shroud 30 is secured to outer wall surface 22 of mandrel 21 by any device or method known in the art, including but not limited to threads (not shown). As shown in FIG. 1, a portion of outer wall surface 22 of mandrel 21, shoulder 25, and inner wall surface 34 of shroud 30 partially define chamber 39. Seal 26 is disposed between outer wall surface 22 of mandrel 21 and inner wall surface 34 of shroud 30 to prevent leakage from chamber 39.

Figure 2:
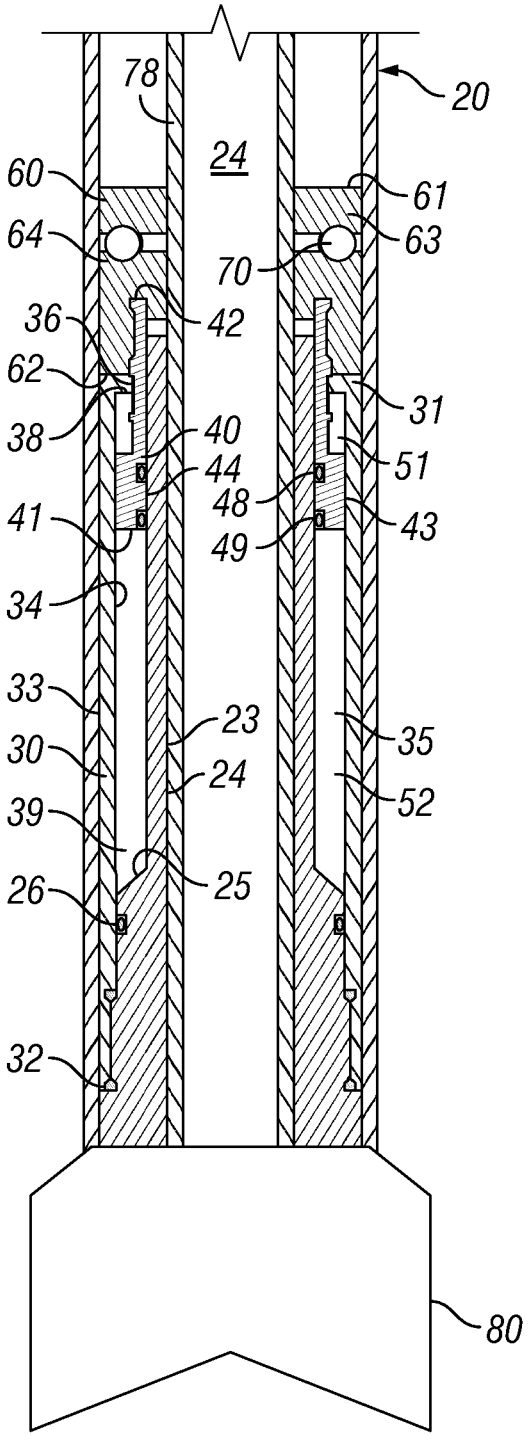
FIG. 2 is a partial cross-sectional view of the bearing assembly of FIG. 1 shown in a compressed position.

An actuator shown as piston 40 is partially disposed within chamber 39. In the embodiment of FIGS. 1-2, piston 40 comprises a sleeve member having lower end 41, upper end 42, outer wall surface 43 and inner wall surface 44. Outer wall surface 43 is in sliding engagement with inner wall surface 34 of shroud 30 and inner wall surface 44 is in sliding engagement with outer wall surface 22 of mandrel 21. Seals 48, 49 (FIG. 2) reduce the likelihood of fluid leakage between the engagement of outer wall surface 43 with inner wall surface 34 and between the engagement of inner wall surface 44 with outer wall surface 22.

Upper end 42 of piston 40 is secured to bearing assembly 60 through any device known in the art, including but not limited to threads (not shown). Bearing assembly 60 includes upper end 61, lower end 62, upper portion 63, and lower portion 64. Lower portion 64 is secured to upper end 42 of piston 40 and, in the embodiment of FIGS. 1-2, is secured to inner wall surface 82 of housing 85, discussed in greater detail below. Suitable devices and methods for securing lower portion 64 to outer wall surface 22 include welding or threads (not shown). Upper portion 63 is in friction fit between inner wall surface 82 of housing 85 and outer wall surface 79 of rotating tubular 78. Thus, upper portion 63 is not prohibited from rotating. Upper portion 63 and lower portion 64 are operatively associated with bearing 70 shown in FIGS. 1-2 as ball bearings.

A lower portion of piston 40 is disposed within chamber 39, a portion of upper end 42 of piston 40 is disposed outside of chamber 39 so as to facilitate connection to lower portion 64, and a middle portion of piston 40 is disposed within opening 36 of upper end 31 of shroud 30. Thus, chamber 39 is closed off by a portion of piston 40 being disposed within opening 36.

In addition, because piston 40 is in sliding engagement with inner wall surface 34 of shroud 30 and outer wall surface 22 of mandrel 21, chamber 39 is divided by piston 40 into two portions: upper portion 51 (shown in FIG. 2) and lower portion 52. Lower portion 52 can be at atmospheric pressure, can include a hydraulic fluid, a compressible gas or other fluid, or a compressible device, e.g., an elastomeric sleeve or spring, that is biased toward upper end 31 of shroud 30, i.e., the arrangement shown in FIG. 1 which is referred to as an expanded position because in this position, gap 95 is present between upper end 31 of shroud 30 and lower end 62 of bearing assembly 60.

Gap 95 can have any dimensions desired or necessary to facilitate longitudinal or vertical movement of shroud 30 and, thus, mandrel 21 and drill bit 80. As will be understood by persons skilled in the art, the size of gap 95 can be modified to allow greater, or lesser, vertical movement of shroud 30. Vertical movement of shroud 30 and, thus, mandrel 21 and drill bit 80, allows drill bit 80 to absorb shocks or other forces or stimuli that could otherwise cause drill bit 80 to bounce off of the object being drilled or cause the drill string to buckle or otherwise be damaged. Accordingly, vertical movement of shroud 30 and, thus, mandrel 21 and drill bit 80 facilitate maintaining engagement of drill bit 80 with the object being drilled, instead of bouncing off of the object, so that interruptions of drilling operations are minimized.

Bearing housing 85 is disposed over shroud 30 and includes outer wall surface 81 and inner wall surface 82 defining bore 83. In the embodiment of FIGS. 1-2, upper portion 63 is in a friction fit relationship with inner wall surface 82 of bearing housing 85 and lower portion 64 is secured to inner wall surface 82 of bearing housing 85. Lower portion 64 can be secured to inner wall surface 82 through any device or method in the art such as welding or threads. As piston 40 is secured to lower portion 64 and lower portion 64 is secured to inner wall surface 82 of housing 85 in the embodiment of FIGS. 1-2, piston 40 is not rotatable. Outer wall surface 33 of shroud 30, however, is in sliding and rotatable engagement with inner wall surface 82 of bearing housing 85. Further, as neither of shroud 30 nor mandrel 21 are fixed to piston 40 or housing 85, shroud 30 and mandrel 21 are not prohibited from rotating. As a result, any residual rotation force imparted to shroud 30 or mandrel 21 by rotating tubular 78 can cause shroud 30 and mandrel 21 to rotate.

In one operation of a specific embodiment of the bearing assemblies as disclosed herein, the bearing assembly is disposed in a bearing housing and operatively associated with a rotatable tubular which is connected to a drill bit. The rotatable tubular is operatively associated with a motor that rotates the tubular. The mandrel and motor are included in work or tool string, also referred to as a drill string, and disposed within a wellbore so that an object within the wellbore can be drilled, milled, etc.

Upon reaching the desired location within the well, the motor is activated and the tubular rotated. As a result, the drill bit rotates and drills, mills, abrades, etc. an object within the wellbore. In certain embodiments, the object being drilled is the formation itself. In other embodiments, the object is a packer, cement, bridge plug, stuck tool, or other device or component disposed within the wellbore.

During drilling operations, a force can be encountered that tries to move the drill bit. The force can be initiated any source, including but not limited to, by the contour of the object being drilled or by a change in the density of the object being drilled. The bearing assembly includes a compensator member that can compensate or counteract an upward force acting on the drill bit and, thus, the tubular. In the embodiment of FIGS. 1-2, the compensator member comprises chamber 39. As illustrated in FIGS. 1-2, when an upward force acts on drill bit 80, drill bit 80 forces mandrel 21 and, thus, shroud 30 move upward. In so doing, mandrel 21 and shroud 30 slide along piston 40 and the compensator member, i.e., chamber 39, moves from its expanded position (FIG. 1) toward one of its plurality of compressed positions (one of which is shown in FIG. 2). As a result, chamber 39 becomes energized, e.g., the fluid or gas, spring, elastomeric sleeve, and the like, disposed within lower portion 52 of chamber 39 is compressed, and the bearing assembly absorbs at least some of the upward force acting on the drill bit.

After the upward force acting on drill bit 80 dissipates, the energized compensator member moves from a compressed position toward the expanded position. Due to the absorption of the upward force, the amount of time, if any, that the drill bit is disengaged from the object being drilled is minimized.

In embodiments in which one or more of an elastomeric material, spring, or other biased member or device is disposed within chamber 39, these biased member(s) or device(s) facilitate returning the compensator member toward the expanded position.

It is to be understood that the invention is not limited to the exact details of construction, operation, exact materials, or embodiments shown and described, as modifications and equivalents will be apparent to one skilled in the art. For example, lower portion 64 can be in rotatable engagement with outer wall surface 82 of housing 85. Moreover, gap 95 can be extended longitudinal to permit additional longitudinal movement of shroud 30 and, thus, mandrel 21. In addition, piston 40 is not required to be piston or a sleeve piston as shown in FIGS. 1-2. Further, the bias provided by lower portion 52 of chamber 39 is not required to be provided by a fluid or elastomer, but can include any other biased member such as a coiled spring or Belleville washers and the like. Additionally, it is to be understood that the bearing assemblies disclosed and taught herein can be used in connection with any downhole tool in which one component is rotated and another remains stationary, including mills or abrading downhole tools used in cased wellbores. Moreover, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. Moreover, the mandrel and the shroud can be formed from a single unitary tubular member. Accordingly, the invention is therefore to be limited only by the scope of the appended claims.

What is claimed is:

1. A bearing assembly for a rotatable downhole tool, the bearing assembly comprising:

a bearing member;

a slidable member operatively associated with the bearing member; and a compensator member operatively associated with the slidable member and the bearing member, the compensator member positioned between the bearing member and at least a portion of the slidable member, the compensator member having an expanded position and a plurality of compressed positions, the slidable member being slidable relative to the bearing member causing the compensator to move between the expanded position and at least one of the plurality of compressed positions;

wherein the slidable member is operatively associated with the bearing member by a piston, the piston having a first end secured to the bearing member and a second end in sliding engagement with the slidable member.

2. The bearing assembly of claim 1, wherein the compensator member comprises a chamber partially defined by the slidable member, a portion of the piston being disposed within the chamber and in sliding engagement with the slidable member.

3. The bearing assembly of claim 2, further comprising a bearing housing, the bearing housing having an inner wall surface in sliding engagement with an outer wall surface of the slidable member.

4. The bearing assembly of claim 2, wherein the slidable member is operatively associated with a rotatable tubular having a drill bit disposed at a lower end of the rotatable tubular, the rotatable tubular having an outer wall surface in rotational engagement with the bearing member and the piston.

5. The bearing assembly of claim 2, wherein the slidable member comprises a mandrel and a shroud, the shroud having a first end and a second end, wherein the first end is secured to the mandrel, and wherein, the shroud and mandrel partially define the chamber.

6. A bearing assembly for a rotatable downhole tool, the bearing assembly comprising:

a housing having an outer wall surface and an inner wall surface defining a housing bore;

a fixed bearing member, the fixed bearing member being secured to the inner wall surface of the housing;

a rotatable bearing member operatively associated with the fixed bearing member by a bearing;

an actuator having a first end and a second end, the first end being secured to the fixed bearing member, the actuator being operatively associated with an outer wall surface of a rotatable tubular disposed through the housing bore, the fixed bearing member, and the rotatable bearing member;

a mandrel; and a shroud having a first end, a second end, an outer wall surface, and an inner wall surface defining a shroud bore, the first end having an opening disposed there-through, the second end being secured to the outer wall surface of the mandrel, and the inner wall surface of the shroud and the outer wall surface of the mandrel partially defining a chamber, wherein a portion of the actuator is disposed through the opening, and the second end of the actuator is disposed in the chamber and in sliding engagement with the inner wall surface of the shroud and the outer wall surface of the mandrel.

7. The bearing assembly of claim 6, wherein the actuator comprises a piston.

8. The bearing assembly of claim 6, wherein the chamber is further partially defined by a shoulder disposed on the outer wall surface of the mandrel.

9. The bearing assembly of claim 6, wherein the first end of the shroud includes a shoulder portion at least partially defining the opening.

10. The bearing assembly of claim 6, wherein an outer wall surface of the rotatable bearing member is in rotatable engagement with the inner wall surface of the housing and an inner wall surface of the rotatable bearing member is in rotatable engagement with the outer wall surface of the rotatable tubular.

11. The bearing assembly of claim 6, wherein an outer wall surface of the shroud is in rotatable and sliding engagement with the inner wall surface of the housing.

12. The bearing assembly of claim 6, wherein a biased member is disposed within a portion of the chamber.

13. The bearing assembly of claim 12, wherein the biased member comprises a hydraulic fluid in fluid communication with the second end of the actuator.

* * * * *